US005235132A

United States Patent [19]

Ainsworth et al.

[11] Patent Number: 5,235,132

[45] Date of Patent: Aug. 10, 1993

[54] EXTERNALLY AND INTERNALLY SHIELDED DOUBLE-LAYERED FLAT CABLE ASSEMBLY

[75] Inventors: James C. Ainsworth, Chandler; Glen A. Milnes, Laveen, both of Ariz.

[73] Assignee: W. L. Gore & Associates, Inc., Newark, Del.

[21] Appl. No.: 827,667

[22] Filed: Jan. 29, 1992

[51] Int. Cl.[5] ..... H01B 7/08; H01B 7/34

[52] U.S. Cl. ..... 174/36; 156/55; 156/56; 174/115; 174/117 F; 174/117 FF

[58] Field of Search ..... 174/36, 117 F, 117 FF, 174/115, 110 FC; 156/55, 56

[56] References Cited

U.S. PATENT DOCUMENTS

| | | | |
|---|---|---|---|
| 3,173,991 | 3/1965 | Breakfield, Sr. | 174/117 FF |
| 3,582,532 | 6/1971 | Plummer | 174/36 |
| 3,700,825 | 10/1972 | Taplin et al. | 174/36 |
| 4,382,236 | 5/1983 | Suzuki | 174/117 FF X |
| 4,513,170 | 4/1985 | Apodaca | 174/36 |
| 4,639,693 | 1/1987 | Suzuki et al. | 174/117 F X |
| 4,707,671 | 11/1987 | Suzuki et al. | 174/117 F X |
| 4,798,918 | 1/1989 | Kabadi et al. | 174/36 |
| 5,003,126 | 3/1991 | Fujii et al. | 174/36 |
| 5,136,123 | 8/1992 | Kobayashi et al. | 174/117 FF |

FOREIGN PATENT DOCUMENTS

| | | | |
|---|---|---|---|
| 2424442 | 11/1975 | Fed. Rep. of Germany | 174/117 FF |

*Primary Examiner*—Morris H. Nimmo

*Attorney, Agent, or Firm*—Gary A. Samuels

[57] ABSTRACT

A double-layered flat electrical signal assembly comprising a shielded insulated flat cable on each side of a perforated separator material which may be conductive metal or non-metal. Controlled impedance signal transmission through high density insulation displacement connectors to PCB's.

4 Claims, 2 Drawing Sheets

EXTERNALLY AND INTERNALLY SHIELDED DOUBLE-LAYERED FLAT CABLE ASSEMBLY

FIELD OF THE INVENTION

The invention relates to flat multiconductor coaxial electrical cables terminable on closely spaced insulation displacement connectors.

BACKGROUND OF THE INVENTION

A low dielectric constant controlled impedance coaxial cable is currently constructed with insulated signal and integrated drain conductors formed into a closely spaced flat cable having closely-spaced parallel conductors, conductive shielding attached to both sides of the cable, then an outer protective coating or jacket applied.

This construction allows a high fidelity controlled impedance signal cable to be formed which can be terminated to insulation displacement connectors. A low dielectric constant porous polytetrafluoroethylene or a foamed polymer insulation allows these electrical characteristics.

However, recent developments in insulation displacement connectors which provide for efficient high density use of tightly spaced printed circuit board (PCB) footprints allow use of as little as 50% of the PCB surface space with the same signal to pin ratio. This is accomplished by placing two 0.050 inch pitch flat cables into a single connector and maintaining the 0.050 inch spacing through the connector into the PCB. Presently available flat cables of 0.050 inch pitch can be accepted into a connector, but the connector converts the PCB pin spacing to 0.100 inch. If the cable is made with a pitch of 0.025 inch and used with a similar 0.025 inch cable, the PCB pin spacing is 0.050 inch, but that high pin density allows use of signal conductors of only 30 AWG maximum conductor size.

It would be desirable to have a single high-density cable having shielded conductors of larger than the presently usable size along with controlled impedance and matable with a high-density insulation displacement connector. The invention provides a cable which solves the problem of good properties with very close spacings.

SUMMARY OF THE INVENTION

The invention comprises a double-layered flat electrical cable assembly comprising two flat electrical signal cables located on each side of a sheet of separator material. Each flat cable comprises a multiplicity of parallel coplanar conductors surrounded by low dielectric constant insulation and spaced apart by a web of the insulation. A conductive metal shield is applied to one side of each flat cable (the outside) and the shield covered with an insulative outer jacket. The separator material, on each side of which is placed one of the flat cables, shield side out, is preferably of perforated conductive metal, such as copper for example, to provide a cable having a single-ended signal configuration. Where less stringent shielding conditions are needed, such as for 150 ohm differential or balanced signal pairs, the separator may be of a perforated polyimide polymer, such as Kapton®, for example. Shield integrated drain wires may be present in the flat cables as well. The stacked configuration of the cable of the invention provides twice the board density of the 0.025 inch pitch cables referred to above because the stacked cable requires no grounds between signal conductors to give the same single-ended performance.

DETAILED DESCRIPTION OF THE INVENTION

Figure 1:
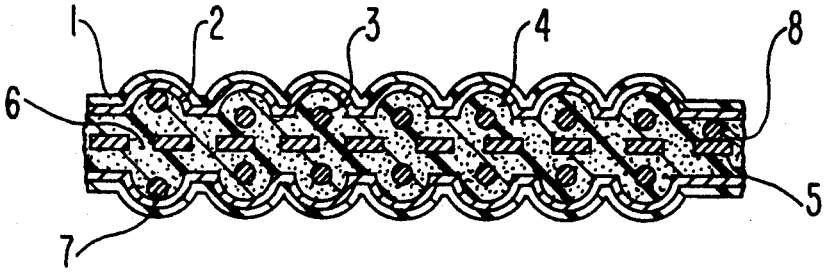
FIG. 1 is a cross-sectional view of a cable of the invention, including shield integrated drain wires.
Figure 2:
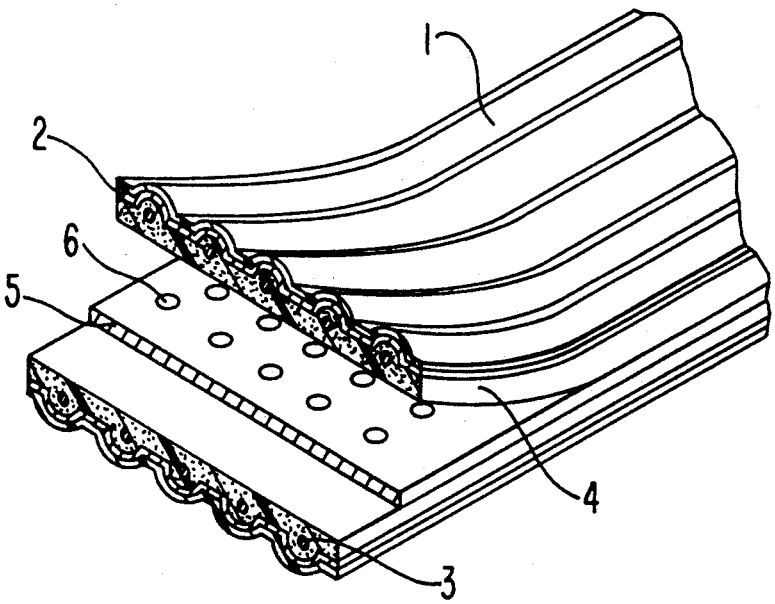
FIG. 2 is a perspective cross-sectional view of a cable of the invention having some of the layers separated for clear viewing.

The invention provides a cable having two rows of primary conductors which are insulated with a low dielectric constant material. An outer integrated conductive shield is then applied and formed around the insulated primary conductors. An outer insulating jacket is then applied. The two rows of insulated primary conductors are separated by an inner conductive shielding material which is preferably perforated at spaced intervals or is conductive mesh, which is usually made by slitting a conductive sheet at intervals, then stretching the sheet in the direction opposite to the direction of slitting to form a mesh. The gaps created thereby allow bonding of insulation layers through the openings in the perforated sheet or mesh.

This type of construction provides a cable that will have controlled impedance, transmit high fidelity electronic signals, and have separable layers for installation in high density 0.050 inch pitch insulation displacement connectors. The center and outer shield material provide individual line conductor electrical isolation for high-speed single-ended digital pulses or analog signals. For differentially-driven or balanced pair driven signals, the center shield material could be replaced by a non-conductive separator. The outer shields provide pair-to-pair electrical isolation.

The manufacturing processes for the cable are based on utilization as the insulation of sintered or unsintered full-density or expanded polytetrafluoroethylene (PTFE) and other low-dielectric constant fluorocarbon polymer tapes combined with cabling and sintering processes. A low dielectric constant insulation material, such as the above, expanded PTFE for example, surrounds copper conductors of 28–30 AWG size, for example. The insulation is applied by typical tape-wrap or extrusion processes to give an insulated primary conductor.

The insulated primary conductors are cabled into a flat ribbon cable with low dielectric constant insulative material, being laid parallel to each other and optionally on a controlled dimensional pitch. The insulated primary conductors are fed between sheets of low dielectric constant thermoplastic sheets, such as fluorinated ethylene-propylene copolymer (FEP), into heated rollers and the tapes formed around the insulated primary conductors, which are bonded together by a web area of FEP between them. Tooling around or near the hot rollers provide the required pressure to form the webs and control the cable dimensions, such as conductor pitch and span, as well as the cable thickness. Cable width control is provided by a subsequent edge trim.

The completed unshielded cable may have an unsymmetrical cross-section to facilitate further processing into one-sided shielded cable or stacked shielded cable having high fidelity signal transmission and close spacing for high-density printed circuit boards (PCB).

For a shielded cable, a conductive shield material is fed into a second set of rollers immediately preceding the cabling rollers to partially imbed the shielding into the cable insulation. The cable and shielding material are fed together into an extruder to apply a covering protective outer jacket insulation, such as PVC, polyurethane, FEP, polyvinylidene fluoride, perfluoroalkoxy tetrafluoroethylene, ethylene-tetrafluoroethylene copolymers, or vinylidene fluoride chlorotrifluoroethylene copolymers. The shielding material may be coated with an adhesive, such as FEP, polyester, or polyurethane and is preferably perforated or mesh as described above. Conductive drain wires may be provided adjacent to and in electrical contact with the outer shielding and conductive separator.

Where a stacked fully shielded cable is being made, a second set of cabling tapes and insulated primary conductors are fed between the heated compression rollers along both sides of a conducting (or non-conductive) separating sheet, then a sheet of preformed outer shielding on each side of the cable and the cable and any desired drain wires fed into a second set of compression rollers to yield a stacked, fully shielded cable, which is then passed through an edge trim and a protective jacket extruded around the cable.

With reference now to the drawings, the invention is now described in more detail. A double-layer flat cable of the invention is depicted in cross-section in FIG. 1, where the shield integrated drain wires 7 and a multiplicity of parallel coplanar signal conductors 3 in two layers are shown surrounded and spaced evenly apart by low dielectric constant porous insulation 4. Porous expanded polytetrafluoroethylene (PTFE), such as that disclosed in U.S. Pat. Nos. 3,953,566, 3,962,153, 4,096,227, 4,187,390, 4,478,665, or 4,902,423, assigned to W. L. Gore & Associates, Inc., from which such low dielectric constant materials may be obtained, is preferred as the porous insulation. A foamed polyethylene, polyvinyl chloride, or fluorinated ethylenepropylene copolymer (FEP) insulation may also be used, as well as any thermoplastic material known in the art as signal cable insulation where use of the resulting cable at high temperatures does not cause a problem. Porous expanded PTFE is well known to provide the lowest dielectric constant at high temperatures and is therefore preferable in this application.

The insulated signal wires 3 and the drain wires 7 are covered on one side by a conductive shielding material 2, such as metal foil, metal-plated polymer film, or braided conductive wire or tape and shielding material 2 covered with a protective jacket 1, such FEP or other thermoplastic material. Two sets of flat cables as described above are layered on each side of a sheet of perforated separator material 5, which may be conductive metal shielding, usually of perforated copper, copper alloy, or aluminum, with the shielding 2 side of each cable arranged outwardly. The perforations 6 in the separator material 5 serve to allow bonding of insulation layer 4 through the perforations 6 to provide integrity to the double-layered cable. The drain wires 7 are in electrical contact throughout their length with shielding 2 in order to provide an integrated grounding circuit with the cable connector and PCB with which it is mated. Additional drain wires, such as drain wire 8 may be placed in the cable to connect a conductive separator 5.

Useful processes and methods of manufacture for the cable of the invention also include those well known in the art, such as the flat cabling methods disclosed and described in U.S. Pat. Nos. 3,082,292, 3,380,269, 3,540,956, 3,649,434, 4,443,657, 4,824,037, 3,775,552, 4,096,006, 4,234,759, 4,487,992, 4,412,092, and 4,639,693, in which sheets of jacket polymer, shielding, insulation, and signal wires are fed in proper order between heated grooved pinch rolls and the flat cable formed under pressure and/or heat. Also useful in this invention are expanded PTFE-insulated primary conductors used together with FEP (and the like) cabling tapes as described above.

As mentioned above, separator 5 may be of perforated conductive metal sheet or mesh shielding material if the application of the cable requires single ended signal configuration and may have shield integrated drain wires, such as 7 or 5, in addition to signal wires or the drain wires may be omitted in embodiments of the cable where not useful or required. Separator 5 is preferably a non-conductive perforated polymeric material, such as Kapton® polyimide, for easy separation of the two signal cable layers for easy termination at an insulation displacement connector if a differential balanced signal pair configuration is desired for an application of the cable.

Figure 3:
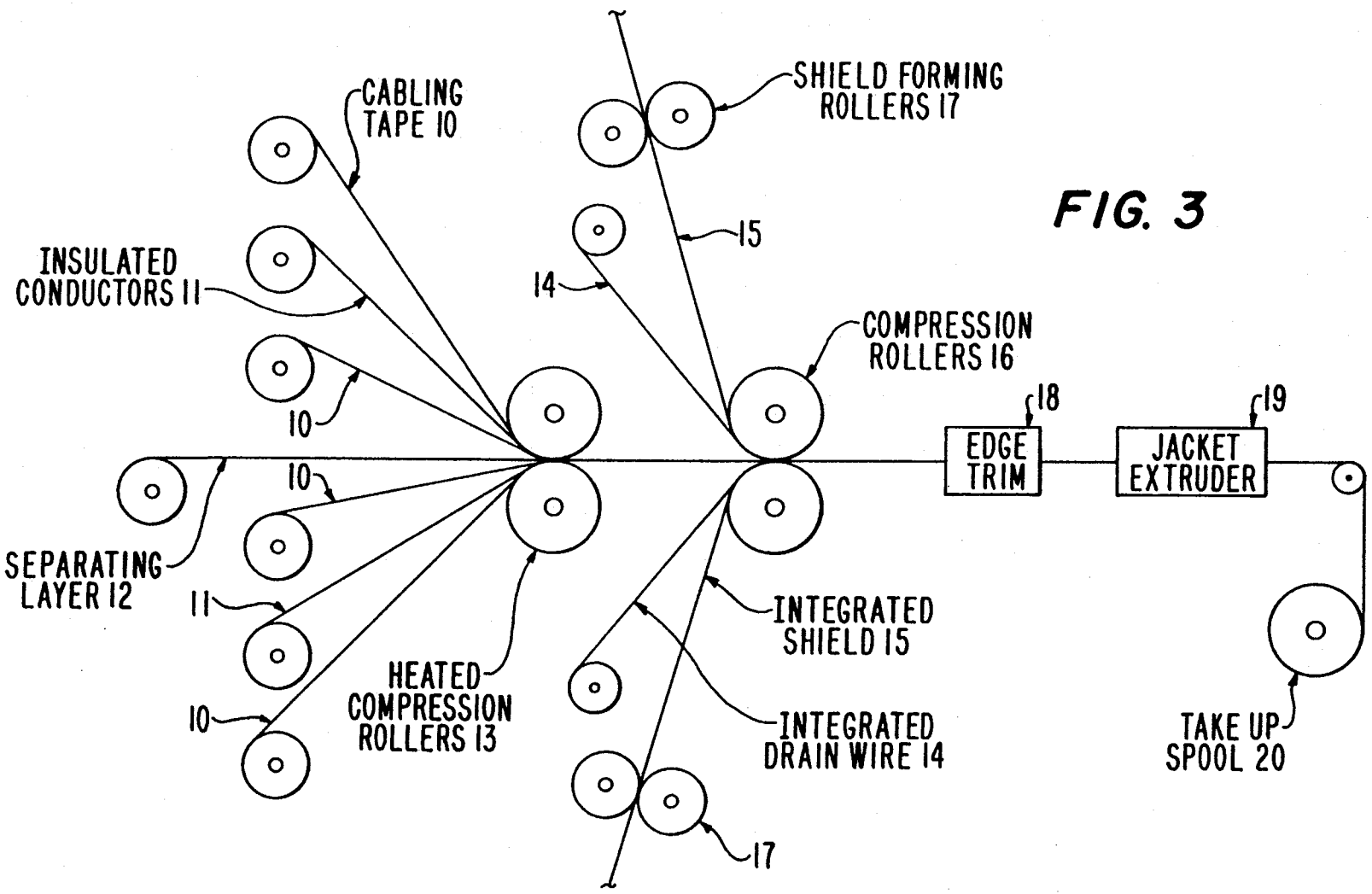
FIG. 3 is a schematic diagram of a process for manufacture of a cable of the invention.

FIG. 3 is a schematic diagram of a manufacturing process which can be used to make a cable of the invention. Insulated primary conductors 11 are positioned between low-dielectric constant fluorocarbon cabling tapes 10 on each side and the conductors 11 and tapes 10 passed between heated compression rollers 13. A second set of tapes 10 and conductors 11 also passes at the same time into rollers 13. Set between the two sets of tapes 10 and conductors 11 is a separating layer 12 which passes into rollers 13 between the two sets of tapes 10 and conductors 11. Layer 12 is usually a perforated sheet or mesh of conductive metal, but may be non-conductive if a cable is being manufactured for a specific application not requiring a shielding separating layer. Rollers 13 press and form the various layers fed into it into a single composite cable which next passes between a second set 16 of compression rollers layered between shielding layers 15 which have been formed and shaped to fit the contours of the cable by shield forming rollers 17. The cable and a shield on each side passes through rollers 16, thence into an edge trim device 18 and a jacket extruder 19 where an outer protective polymer jacket is extruded onto the cable. The outer jacket may be semiconductive. The finished cable is taken up on spool 20.

A cable of the invention has the advantage of controlled impedance of signal transmission combined with very high transmission line density and is useful with high-density insulation displacement connectors for attachment of flat signal cables to a PCB. A cable of the invention may be made on a 0.050 inch pitch signal wire spacing with insulation displacement connectors of 0.050 inch pin spacing with 28 AWG or larger diameter conductors.

I claim:

1. A double-layered flat electrical signal assembly comprising two flat electrical signal cables located on each side of a sheet of perforated conductive metal separator material, each said flat cable comprising a multiplicity of insulated electrical signal conductors arranged in a parallel coplanar configuration at a specified distance apart, said conductors each being surrounded by low dielectric constant insulation and a web of insulation located between said conductors, said insulated conductors covered as a unit by a conductive metal shield on at least one side of said cable, and each said shield covered by an insulative outer jacket.

2. A cable of claim 1 wherein said sheet of perforated conductive metal separator material is a mesh.

3. A process for manufacturing a double-layered flat electrical signal assembly, comprising the steps:

(a) surrounding each conductor of two multiple sets of electrical signal conductors with a low-dielectric constant insulation;

(b) passing two said sets of conductors, a low-dielectric constant cabling tape on each side of each set of conductors, and a sheet of conductive or non-conductive separator material located between each set of conductors together into the nip of a first set of heated compression rollers;

(c) passing the flat cable issuing from said rollers together with a sheet of formed conductive shielding located on each side of said cable and one or more conductive drain wires into the nip of a second set of compression rollers;

(d) passing the cable issuing from said second set of compression rollers into an edge trim device;

(e) passing the cable issuing from said edge trim device into a jacket extruder;

(f) extruding a protective polymeric outer jacket onto said cable issuing from said edge trim device; and (g) taking up said assembly on a takeup spool.

4. A double-layered flat electrical signal assembly manufactured by the process of claim 3.

* * * * *